US007441335B2

(12) United States Patent
Imamura et al.

(10) Patent No.: US 7,441,335 B2
(45) Date of Patent: Oct. 28, 2008

(54) METHODS OF ELECTROMAGNETIC FORMING ALUMINUM ALLOY WHEEL FOR AUTOMOTIVE USE

(75) Inventors: Yoshihaya Imamura, Fujisawa (JP); Hiroyuki Yamashita, Shimonoseki (JP)

(73) Assignee: Kabushiki Kaisha Kobe Seiko Sho (Kobe Steel, Ltd.), Kobe-shi (JP)

( * ) Notice: Subject to any disclaimer, the term of this patent is extended or adjusted under 35 U.S.C. 154(b) by 58 days.

(21) Appl. No.: 10/933,287

(22) Filed: Sep. 3, 2004

(65) Prior Publication Data

US 2005/0091850 A1 May 5, 2005

(30) Foreign Application Priority Data

Sep. 4, 2003 (JP) ..... 2003-312198

(51) Int. Cl.
*B23P 17/00* (2006.01)

(52) U.S. Cl. ..... 29/894.35; 29/894.322; 29/894.353; 29/419.2; 72/707

(58) Field of Classification Search ..... 29/894.322, 29/894.35, 894.353, 894.362, 419.2; 72/707
See application file for complete search history.

(56) References Cited

U.S. PATENT DOCUMENTS

| | | | | |
|---|---|---|---|---|
| 2,291,393 | A * | 7/1942 | Le Jeune | 29/894.353 |
| 4,334,417 | A * | 6/1982 | Victor | 72/56 |
| 4,408,379 | A * | 10/1983 | Kusano et al. | 29/894.353 |
| 5,826,320 | A * | 10/1998 | Rathke et al. | 29/419.2 |
| 6,073,347 | A * | 6/2000 | Cvijanovic et al. | 29/894.323 |
| 6,513,241 | B1 * | 2/2003 | Shalosky | 29/894.322 |

FOREIGN PATENT DOCUMENTS

| | | |
|---|---|---|
| JP | 56-79001 | 6/1981 |
| JP | 56-131033 | 10/1981 |
| JP | 58-4601 | 1/1983 |
| JP | 60-158933 | 8/1985 |
| JP | 63-56935 | 4/1988 |
| JP | 4-356322 | 12/1992 |
| JP | 6-23442 | 2/1994 |
| JP | 6-312226 | 11/1994 |
| JP | 8-24969 | 1/1996 |
| JP | 8-168814 | 7/1996 |
| JP | 9-166111 | 6/1997 |
| JP | 2000-254746 A | 9/2000 |
| WO | WO 00/16927 | 3/2000 |

* cited by examiner

*Primary Examiner*—David P. Bryant
*Assistant Examiner*—Sarang Afzali
(74) *Attorney, Agent, or Firm*—Oblon, Spivak, McClelland, Maier & Neustadt, P.C.

(57) ABSTRACT

A metal mold for electromagnetic forming, with the inner peripheral face thereof, serving as a forming face, is disposed on the outer peripheral side of a columnar workpiece, and a coil for electromagnetic forming is disposed on the inner peripheral side of the columnar workpiece. In a state of a configuration as described, electric energy is thrown into the coil for the electromagnetic forming, and the columnar workpiece is caused to undergo flaring to be thereby pressed against the forming face of the metal mold for the electromagnetic forming, so as to be turned into a shape corresponding to the forming face by means of the electromagnetic forming, thus obtaining a wheel rim. A disc is welded to the wheel rim obtained, and curling is applied to outer edges of the wheel rim. With the adoption of a method of manufacturing an automotive wheel, a manufacturing process as a whole is enhanced in efficiency.

19 Claims, 9 Drawing Sheets

METHODS OF ELECTROMAGNETIC FORMING ALUMINUM ALLOY WHEEL FOR AUTOMOTIVE USE

BACKGROUND OF THE INVENTION

1. Field of the Invention

The present invention relates to a method of manufacturing an automotive wheel and wheel rim, made out of an aluminum alloy sheet or extrusion.

2. Description of the Related Art

As a method of manufacturing an aluminum alloy wheel for use in a passenger car, truck, buggy, and so forth, there have been known three processes of casting, forging, and press working. An aluminum alloy wheel manufactured by casting is generally heavy in weight (although lighter as compared with a steel wheel), and is expensive, so that it is used mainly for an upscale automobile. An aluminum alloy wheel manufactured by forging is excellent in mechanical property, but very expensive, so that it is used for special purposes. Meanwhile, an aluminum alloy wheel manufactured by press working is advantageous in that it is light in weight, and can be manufactured at a low cost.

In Utility Model Laid-open No. 1988-56935, it is described that a wheel is manufactured by deep drawing a sheet material a plurality of times to thereby form two stepped-cup-like members, and joining the respective bottoms thereof together to be welded along the whole circumference of a joint.

Further, in JP-A No. 4601/1983, there is described a method of forming a wheel (particularly, a wheel rim part thereof), comprising the steps of forming a simple cup-like member by deep drawing a sheet material in two stages, subsequently disposing a metal mold for electromagnetic forming, having a forming face on the external face side thereof, inside the cup-like member, and disposing a coil for electromagnetic forming, on the outer peripheral side of the cup-like member, wherein an instantaneous large current is caused to flow to the coil for electromagnetic forming in the state of a configuration as described as above, and the cup-like member is necked down to be thereby pressed against the forming face of the metal mold for the electromagnetic forming. Incidentally, the electromagnetic forming refers to a technology for forming a workpiece into a predetermined shape taking advantage of a phenomenon where a coil for electromagnetic forming produces a strong magnetic field in a very short time by instantaneously throwing (discharging) electric energy (electric charge) stored at a high voltage into the coil for the electromagnetic forming, and the workpiece placed in the magnetic field is subjected to a strong expansion force or contraction force owing to a repulsive force (Lorentz force according to Fleming's left-hand rule) of the magnetic field, thereby undergoing fast plastic deformation. In the case of this example, the cup-like member is necked down in the direction of the inside diameter by the agency of a strong contraction force to be thereby pressed against the forming face of the metal mold for the electromagnetic forming.

In the case of a method as described in Utility Model Laid-open No. 1988-56935, the two stepped-cup-like members formed by deep drawing the sheet material the plurality of times are required since a drop part at the center of a wheel rim is substantially cylindrical in shape, and is small in diameter while the respective side parts of the wheel rim are larger in diameter, however, the method as described in JP-A No. 4601/1983 has an advantage in that one cup-like member can be formed into the shape of the wheel rim by applying the electromagnetic forming only once. Other methods making use of the electromagnetic forming in the field of the automotive wheel include those disclosed in JP-A No. 79001/1981, and WO No. 00/16927, respectively.

In the case of Utility Model Laid-open No. 1988-56935, and JP-A No. 4601/1983, the wheel comprising a disc integrated with the wheel rim at the outset is manufactured, however, a method of manufacturing a wheel is also conceivable whereby a columnar workpiece is formed into a wheel rim by making use of the electromagnetic forming described in JP-A No. 4601/1983, and subsequently, the wheel rim is combined with a disc separately formed to thereby form the wheel. In this case, if a columnar workpiece fabricated by bending a sheet, and joining both edges of the sheet together by welding, or an extrusion as extruded in a columnar shape can be used as the columnar workpiece, an electromagnetic forming system only is sufficient to form the wheel rim (that is, a large-scale deep-drawing system is unnecessary), so that facilities and a manufacturing process can be significantly simplified.

However, in the case of the method of manufacturing the wheel, comprising the steps of forming the columnar workpiece into the wheel rim, and subsequently, combining the wheel rim with the disc separately formed, joining of the wheel rim with the disc used to pose a problem. Accordingly, the method has been difficult to be made commercially viable. As execution of the joining as described by a simple welding will cause a problem of the formation of thinned material regions, due to weld strain and thermal effect, welding has been difficult to apply. Accordingly, as described in WO No. 00/16927, it has been necessary to execute the joining with the use of a special system/method.

Further, in the case of forming the wheel rim by applying the electromagnetic forming to the columnar workpiece, the following problems have been encountered.

(1) In the case of the electromagnetic forming, the forming of the wheel rim is completed in such a very short time as around several hundred μsec, and the wheel rim is in a peculiar shape (the drop part is small in diameter while respective side parts of the wheel rim, on both sides of the drop part. are larger in diameter), so that there is no time for air existing in gaps between the metal mold and the columnar workpiece to escape at the time of the electromagnetic forming, and the air, in particular, at the drop part in the shape of a concave groove, is trapped between the metal mold and material pressed thereto to be thereby pressurized, causing a problem that the air at high pressure interferes with the material being pressed against a portion of the forming face, at the drop part, resulting in poor forming accuracy (localized bulges are formed on a wheel tread of the wheel rim after the completion of the electromagnetic forming). In order to preclude the problem, orifices or slits, serving as vents, may be provided in the metal mold as appropriate, however, to enable the air to vent sufficiently, there is the need for providing a multitude of the orifices or the slits, largish in size, along the forming face, resulting in an increase in the cost of the metal mold as well as deterioration in design versatility due to the columnar workpiece being pressed against the orifices or the slits to thereby undergo deformation.

(2) In the case of applying the electromagnetic forming to the columnar workpiece so as to neck down the columnar workpiece, the inner peripheral face side of the wheel rim (a face thereof, visible from outside when the wheel rim is attached to an automobile) is butted against the forming face of the metal mold for the electromagnetic forming, and is susceptible to being marred. In the way of making up for such a deficiency, there can be adopted means for face milling throughout the inner peripheral face of the wheel rim to thereby maintain attractive appearance, in which case, however, a problem of an increase in processing cost will arise.

(3) Use of an extrusion for the columnar workpiece is advantageous in that the extrusion has no welded spot, and exhibits substantially uniform material properties throughout the entire circumference thereof. However, the following problem is further encountered in the case of applying the electromagnetic forming so as to neck down a columnar extrusion. That is, because the columnar workpiece needs to have a diameter equal to, or slightly larger than the diameter of a part of the wheel rim after the completion of the electromagnetic forming, largest in diameter, there can be a case where it is difficult to provide a suitable columnar workpiece (the larger the diameter of an extrusion, the more difficult it is to execute extrusion molding) depending on the diameter of the wheel rim, in demand.

SUMMARY OF THE INVENTION

It is therefore an object of the invention to resolve a problem encountered in the case of manufacturing an automotive wheel by fitting a disc into a wheel rim after forming, and a problem encountered in the case of forming the wheel rim out of a columnar workpiece by applying electromagnetic forming thereto.

A method of manufacturing an aluminum alloy wheel for automotive use, according to the invention comprises the steps of disposing a metal mold for electromagnetic forming, with the inner peripheral face thereof, serving as a forming face, on the outer peripheral side of a columnar workpiece, and disposing a coil for electromagnetic forming on the inner peripheral side of the columnar workpiece, throwing electric energy into the coil for the electromagnetic forming in a state of a configuration as described, and causing the columnar workpiece to undergo flaring to be pressed against the forming face of the metal mold for the electromagnetic forming, thereby forming a wheel rim having a drop part small in outside diameter, and both side parts each larger in outside diameter than the drop part, forming a disc separately from the wheel rim, and joining the disc to the inner peripheral face of the drop part of the wheel rim. With these features, joining by welding may be adopted in the step of joining the disc.

Further, the method of manufacturing the aluminum alloy wheel for automotive use, according to the invention may comprise the steps of disposing a metal mold for electromagnetic forming, with the inner peripheral face thereof, serving as a forming face, on the outer peripheral side of a columnar workpiece, and disposing a coil for electromagnetic forming on the inner peripheral side of the columnar workpiece, and throwing electric energy into the coil for the electromagnetic forming in a state of a configuration as described, and causing the columnar workpiece to undergo flaring to be pressed against the forming face of the metal mold for the electromagnetic forming, thereby forming a wheel rim having a drop part small in outside diameter, and both side parts each larger in outside diameter than the drop part.

For the metal mold for the electromagnetic forming, use may be made of a metal mold having the forming face in a shape corresponding to the drop part of the wheel rim, and both the side parts thereof. Besides, use may be made of the metal mold for the electromagnetic forming that does not have a forming face corresponding to the whole or respective parts of both the side parts, and is shorter in length of the forming face thereof, in the axial direction, than the length of the wheel rim as formed, in the axial direction thereof, that is, use may be made of the metal mold for the electromagnetic forming, with the inner peripheral face comprising a portion of the forming face, in a shape corresponding to the drop part of the wheel rim, or the drop part of the wheel rim, and respective parts of both the side parts thereof.

In the case where the metal mold for the electromagnetic forming has a forming face corresponding to the drop part, and the whole or respective parts of both the side parts, the forming face, it is preferable that the central part of the forming face, corresponding to the drop part, has the smallest inside diameter, and the inside diameter of the forming face gradually increases from the central part toward respective ends thereof, in the axial direction, without any spot where the inside diameter decreases part of the way toward the respective ends, in the axial direction. Further, the forming face of a metal mold for electromagnetic forming refers to a portion of the inner peripheral of the metal mold, delineating the outer shape of the wheel rim (the drop part at the center, and both the side parts) subjected to the electromagnetic forming.

The columnar workpiece is preferably an extrusion (extruded pipe) with no weld, having uniform wall thickness, however, use may be made of a columnar workpiece fabricated by bending a sheet material to be worked in a columnar shape, and joining both edges of the sheet material together by welding. In the case of using the extrusion, an extrusion fabricated by the mandrel method is more preferable because it has no weld, and further, an extrusion cylindrical in shape is preferable. However, use may also be made of an extrusion in shape similar thereto, for example, an extrusion with a columnar sidewall in the cross-sectional shape of waves continuous along the circumferential direction thereof. Further, an aluminum alloy extrusion in the shape of a pipe, after flaring by applying the electromagnetic forming thereto, may be used as the columnar workpiece. Meanwhile, in the case of using the columnar workpiece fabricated by welding of the sheet material, one cylindrical in shape is preferable, and as a welding method, butt welding is preferable. Further, face milling is preferably applied to a bulging weld joint (weld), thereby rendering the wall thickness of the whole body to become uniform.

By the method described as above, it is possible to manufacture an automotive wheel rim made out of an aluminum alloy sheet or extrusion, wherein a drop part at the center of the wheel rim is substantially cylindrical in shape, and is small in outside diameter while both side parts thereof each are larger in outside diameter than the drop part, a flaring ratio of each of both the side parts being greater than that for the drop part. In the case of using a cylindrical workpiece, the flaring ratio is defined as $\{(a-b)/b\}\times 100$ (%) where the outside diameter of the cylindrical workpiece after forming is a, and the initial outside diameter thereof is b. In the case of using a columnar workpiece in a shape other than a cylinder, it need only be sufficient to calculate using the perimeter thereof after forming, and the initial perimeter thereof, in place of the respective outside diameters. If the columnar workpiece for use has a wall thickness uniform throughout a body thereof, there is formed a wheel rim wherein a drop part thereof is larger in wall thickness, and both side parts thereof are smaller in wall thickness.

Judging from the manufacturing point of view, the preferable shape of the wheel rim is a shape where the outside diameter of the wheel rim, at the drop part, is the smallest, gradually increasing from the drop part toward the respective rim outer edges (outer ends thereof, on both sides of the drop part), without any spot where the outside diameter decreases part of the way from the drop part toward the respective rim outer edges. If the columnar workpiece has, for example, a wall thickness uniform throughout the body thereof, and the electromagnetic forming is applied in the above-described way, aiming at such a shape as the target of the electromagnetic forming, there is formed a wheel rim wherein the wall thickness of the wheel rim is the largest at the drop part, gradually decreasing toward the respective rim outer edges without any spot where the wall thickness increases at any spot part of the way from the drop part toward the respective rim outer edges.

With the method according to the invention, it is possible to manufacture the wheel rim comprising the drop part and both the side parts by applying the electromagnetic forming to a simple columnar workpiece, so that an electromagnetic forming system only is sufficient to manufacture the wheel rim, and facilities and a manufacturing process can be significantly simplified.

By manufacturing the wheel rim by means of the electromagnetic forming as with the present invention, it is possible to inevitably obtain the wheel rim in a form wherein the wall thickness of the drop part is large (an amount of reduction in wall thickness, due to flaring, is small), and the wall thickness of both the side parts, particularly, that of the respective rim outer edges is small (an amount of reduction in wall thickness, due to flaring, is large). The wheel rim in the form described has the following advantages. Firstly, owing to the wall thickness of the drop part being large, the wheel rim tends to be insusceptible to weld strain, and can support a large load when the disc is securely attached to the drop part by welding. Secondly, owing to the wall thickness of the rim outer edges being small, working on the ends on the wheel rim, such as curling, and so forth, can be applied with ease. In other words, the method of manufacturing the wheel rim according to the invention is quite suitable for the method of manufacturing the wheel for automotive use, according to the invention by fitting the disc into the wheel rim after forming.

Thus, with the adoption of the method of manufacturing the wheel according to the invention, a manufacturing process as a whole will be markedly enhanced in efficiency when manufacturing the wheel for automotive use by fitting the disc into the wheel rim after the wheel rim is formed. That is, the wheel rim obtained by making use of the electromagnetic forming, as it is, is rendered suitable for fitting the disc therein, and joining the disc thereto. Furthermore, joining by a common welding method can be applied to such joining without difficulty.

In addition, in the case of manufacturing the wheel, curling is often applied to the respective outer edges of the wheel rim, and taking into account the step of the curling, enhancement in efficiency of the manufacturing process as a whole will become further pronounced. That is, the wheel rim obtained by making use of the electromagnetic forming, as it is, is rendered suitable for efficiently applying the curling to the respective outer edges of the wheel rim.

Still further, with the method of manufacturing the automotive wheel according to the invention, the following effects and advantages are obtained as to only the process of forming the wheel rim out of the columnar workpiece. Such advantageous effects also contribute to enhancement in efficiency of the method of manufacturing the automotive wheel according to the invention.

When the columnar workpiece undergoes flaring at the time of the electromagnetic forming, the columnar workpiece is first pressed against a central part, small in diameter, (corresponding to the drop part of the wheel rim) of the forming face of the metal mold for the electromagnetic forming, and is subsequently first pressed against respective portions, larger in diameter, (corresponding to both the side parts of the wheel rim) of the forming face, on both sides of the central part, so that air existing in gaps between the metal mold and the columnar workpiece can easily escape in the axial direction of the mold in the course of the electromagnetic forming, thereby minimizing a risk that the air is trapped between material and the forming face to be thereby pressurized, causing a problem that the air at high pressure interferes with the material being pressed against the forming face.

Accordingly, with the method of manufacturing the wheel according to the invention, trapped air is allowed to vent, as necessary, without orifices or slits, particularly for serving as vents, provided in the metal mold, or with relatively small orifices or slits provided, so that high forming accuracy can be obtained. In particular, if the inside diameter of the forming face of the metal mold, gradually increases from a spot (the central part) of the forming face, corresponding to the drop part of the wheel rim, toward the respective end sides thereof, in the axial direction, without any spot where the inside diameter decreases part of the way, the air can easily escape in the axial direction.

With the method of manufacturing the wheel according to the invention, a columnar workpiece of a diameter equivalent to, or slightly smaller than the diameter of a spot of the wheel rim having the smallest diameter after forming is used as the columnar workpiece for use in the electromagnetic forming. Accordingly, it follows that in forming a wheel rim of an identical diameter, use is made of a columnar workpiece fairly smaller in diameter than that in the case of necking down the columnar workpiece by the electromagnetic forming. This means that, in the case of using an aluminum alloy extrusion as the columnar workpiece, the upper limit of the diameter of the wheel rim that can be manufactured is expanded (that is, an extrusion can be used for manufacturing even a wheel rim still larger in diameter). Further, an aluminum alloy extrusion, in the shape of a pipe, is caused to undergo flaring by applying the electromagnetic forming thereto, and is then used as a cylindrical workpiece, thereby expanding further the upper limit of the diameter of the wheel rim that can be manufactured. Also, in the case of using an extrusion with a columnar sidewall in the cross-sectional shape of waves continuous along the circumferential direction thereof as the columnar workpiece, it is possible to expand the upper limit of the diameter of the wheel rim that can be manufactured. That is, as the columnar sidewall of the extrusion is in the cross-sectional shape of the waves, the columnar workpiece has rigidity higher than that for a simple cylindrical workpiece, so that geometrical accuracy is improved, thereby enabling a wheel rim larger in diameter to be manufactured.

As described hereinbefore, with the present invention, the wheel rim with both the side parts thereof, smaller in wall thickness, than the drop part thereof is inevitably obtained. The wheel rim with both the side parts smaller in wall thickness, than the drop part is preferable from the viewpoint of reduction in weight of the wheel rim in whole. Among advantages of the method of manufacturing the wheel according to the invention, there is included capability of manufacturing the wheel rim as described out of the columnar workpiece uniform in wall thickness.

Furthermore, the invention is advantageous in that a face of the columnar workpiece undergoing flaring, on the inner peripheral side thereof, is not butted against the forming face of the metal mold for the electromagnetic forming, so that the inner peripheral side of the wheel rim (a face thereof, visible from outside when the wheel rim is attached to an automobile) is not marred due to the forming.

DETAILED DESCRIPTION OF THE PREFERRED EMBODIMENT

An embodiment of a method of manufacturing an automotive wheel according to the invention is broadly classified into two processes, that is, the process of forming a wheel rim out of a columnar workpiece, and the process of making a wheel by joining the wheel rim as formed to a disc separately formed. First, the process of forming the wheel rim out of the columnar workpiece is described in more specific terms with reference to FIGS. 1 to 12.

Figure 1B:
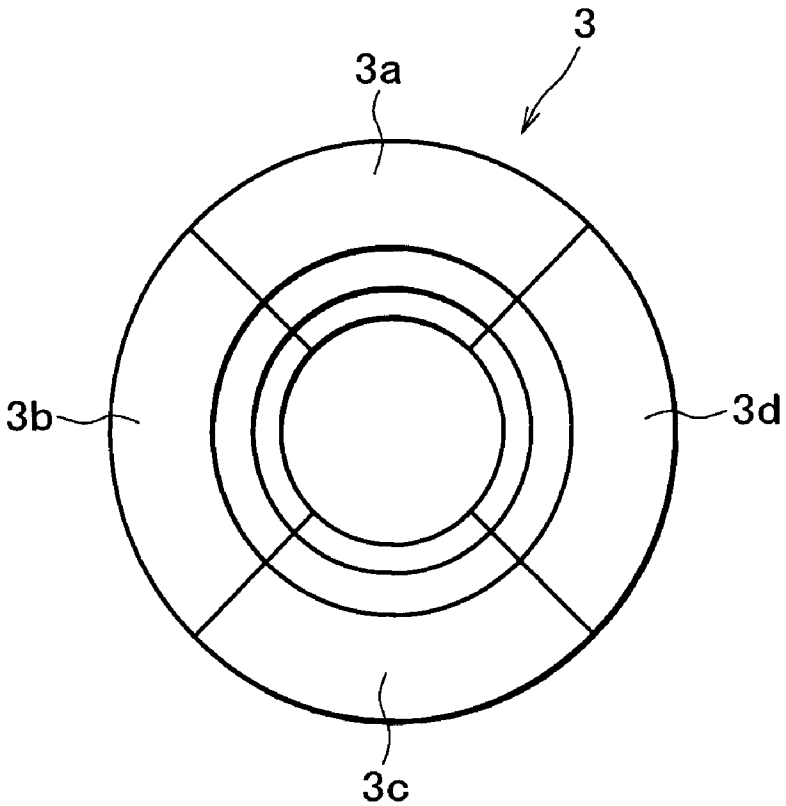
FIGS. 1(*a*) and 1(*b*) are views illustrating a process in a method of manufacturing, according to the invention, for forming an automotive wheel rim by applying electromagnetic forming to a columnar workpiece, in which FIG. 1(*a*) is a sectional view, and FIG. 1(*b*) is a side view.
Figure 1A:
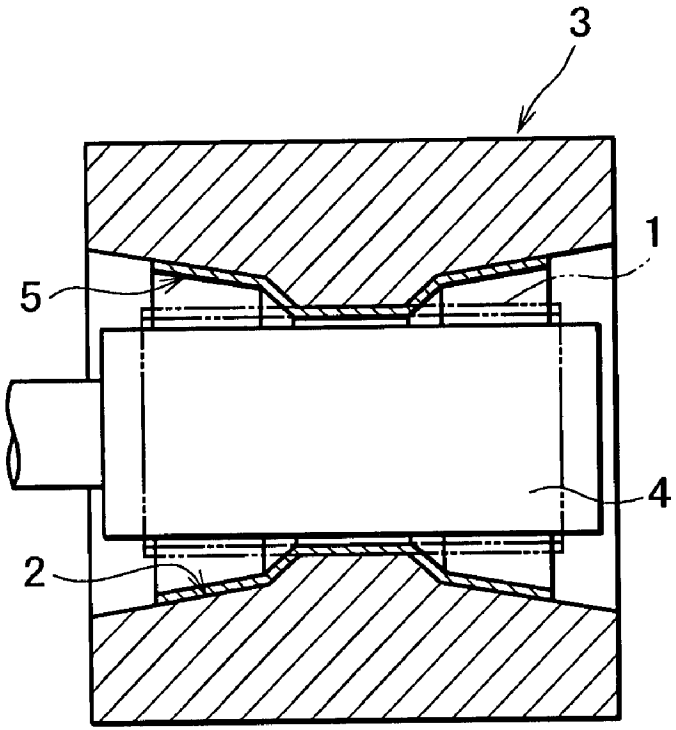
Figure 2:
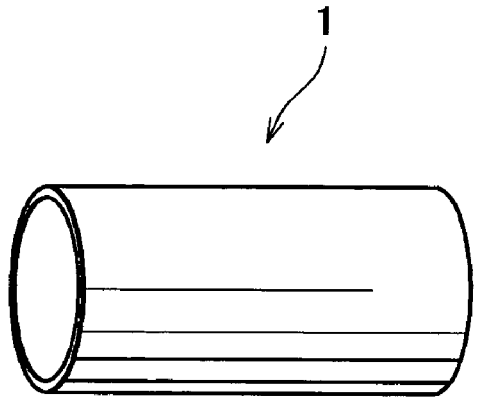
FIG. 2 is a perspective view of the columnar workpiece for use in carrying out the method of manufacturing, according to the invention.

A columnar workpiece 1 shown in FIG. 2 is made out of an aluminum alloy extrusion (a round pipe) circular in cross section, and uniform in wall thickness, and FIG. 1 shows a method of applying electromagnetic forming (flaring) to the columnar workpiece 1. In FIG. 1(*a*), a metal mold 3 for electromagnetic forming, with a forming face 2 provided on the inner face side thereof, is disposed on the outer peripheral side of the columnar workpiece 1, indicated by phantom lines, and a coil 4 for electromagnetic forming is disposed on the inner peripheral side of the columnar workpiece 1. As shown in FIG. 1(*b*), the metal mold 3 for the electromagnetic forming is made up of four divided metal molds 3*a* to 3*d*, divided in the longitudinal direction of the metal mold 3. The metal mold 3 for the electromagnetic forming, the coil 4 for the electromagnetic forming, and the columnar workpiece 1 are disposed such that the respective central axes thereof substantially coincide with each other.

The central part of the forming face 2, corresponding to a drop part of the wheel rim, is cylindrical in shape, having the smallest inside diameter while both side parts thereof are larger in inside diameter. As seen from the central part of the forming face 2 toward both ends thereof, in the axial direction, the inside diameter gradually increases from the central part toward both the ends thereof, without any spot where the inside diameter decreases part of the way. There is formed a slight gap between the external peripheral face of the columnar workpiece 1, and the forming face 2, at the central part. There is also formed a small gap between the inner peripheral face of the columnar workpiece 1, and the coil 4 for the electromagnetic forming.

The metal mold 3 is preferably made of a metal of low conductivity such as, for example, stainless steel. It is also possible to use material other than metal, for example, a non-conducting structural material, such as a fiber reinforced plastic, Bakelite, and so forth. The coil 4 for the electromagnetic forming is a coil for forming, embedded in an electrical insulator.

As the material of the columnar workpiece 1, material easy to be formed, and high in conductivity, is desirable, and, for example, O-alloys of JIS 6000 series, such as 6063, 6061 6N01, etc., are suitable.

Figure 3:
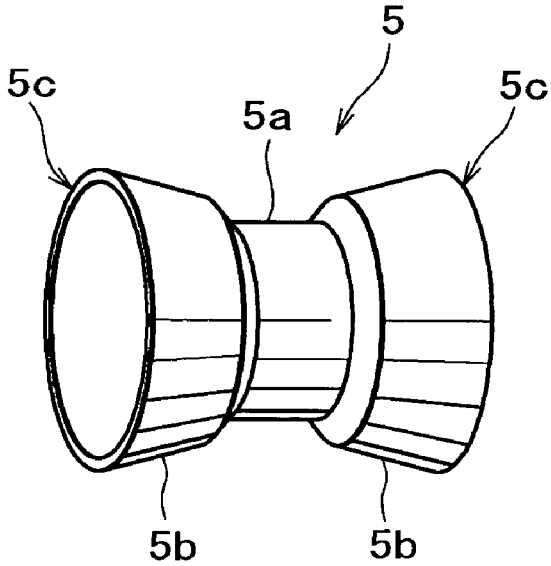
FIG. 3 is a perspective view of the automotive wheel rim formed by an electromagnetic forming process in the method of manufacturing, according to the invention.

In a state shown in FIG. 1(*a*), upon throwing electrical energy into the coil 4 for the electromagnetic forming, a magnetic repulsive force occurs to the columnar workpiece 1, whereupon the columnar workpiece 1 undergoes instantaneous flaring to be thereby butted against the forming face 2 of the metal mold 3, and to be formed into a shape along the forming face 2, thereby being turned into a wheel rim 5 for automotive use, having a drop part 5*a* cylindrical in shape, smaller in outside diameter and side parts 5*b*, 5*b*, on respective sides of the drop part 5*a*, larger in outside diameter (refer to FIG. 3). In the case of an example shown in FIGS. 1 and 3, a flaring ratio of the drop part 5*a* is approximately zero while a flaring ratio of each of both side parts 5*b*, 5*b* is greater than that for the drop part 5*a*, so that both the side parts 5*b*, 5*b* are thinner in wall thickness to that extent as compared with the drop part 5*a*. After completion of the forming, the wheel rim 5 for automotive use can be taken out by dividing the metal mold 5.

Figure 4:
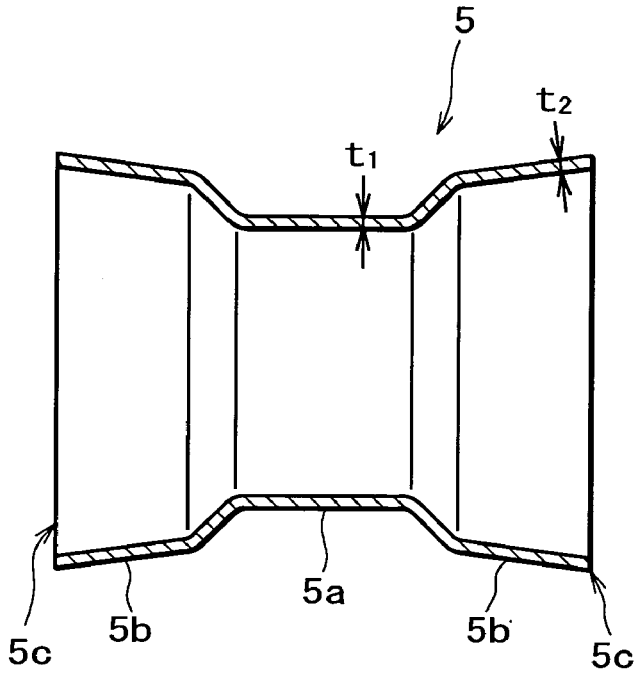
FIG. 4 is a sectional view of the wheel rim in FIG. 3.

FIG. 4 shows a sectional shape of the wheel rim 5, and the outside diameter thereof, at the drop part 5*a*, is the smallest, gradually increasing toward respective rim outer edges 5*c*, 5*c*, without any spot where the outside diameter decreases part of the way from the drop part 5*a* toward the respective rim outer edges 5*c*, 5*c*. Further, the wall thickness of the wheel rim 5 is the largest at the drop part 5*a*, gradually decreasing toward the respective rim outer edges 5*c*, 5*c* ($t_1>t_2$) without any spot where the wall thickness increases at any spot part of the way from the drop part 5*a* toward the respective rim outer edges 5*c*, 5*c*.

Working on wheel rim ends, such as curling, and so forth, is applied to the wheel rim 5 for automotive use, as necessary, and a disc is fixedly attached to the inner periphery of the drop part to thereby form a wheel, whereupon a tire is securely attached to the outer periphery of the wheel rim.

Figure 5:
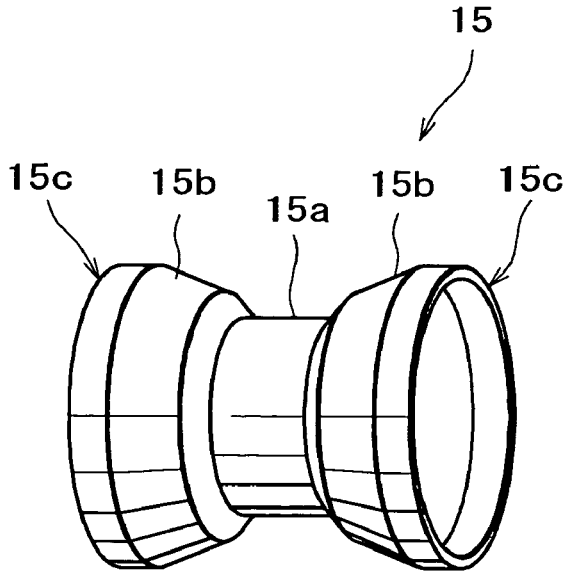
FIG. 5 is a perspective view of another automotive wheel rim formed by the electromagnetic forming process in the method of manufacturing, according to the invention.
Figure 6:
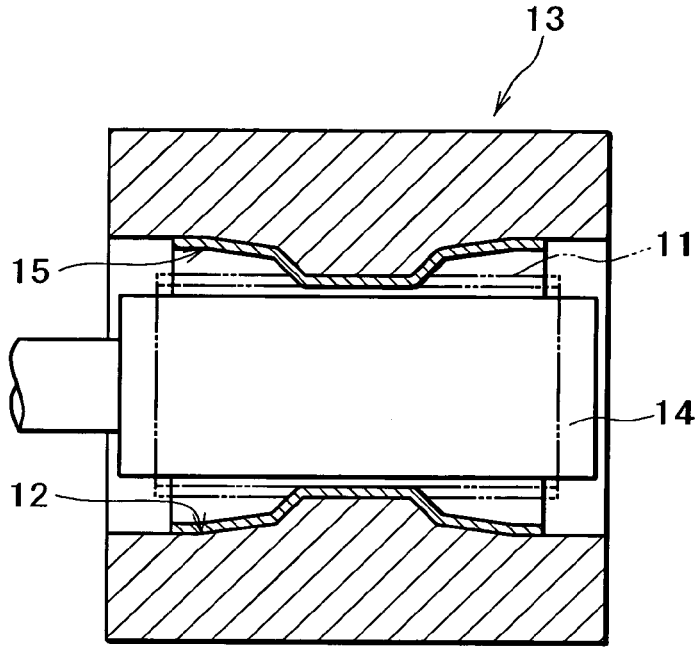
FIG. 6 is a sectional view illustrating the method of manufacturing the wheel rim in FIG. 5.

FIGS. 5 and 6 show another wheel rim and a method of manufacturing the same, according to the invention, respectively.

A wheel rim 15 shown in FIG. 5 is manufactured by flaring of an aluminum alloy extrusion circular in cross-sectional shape, and uniform in wall thickness by means of the electromagnetic forming as with the case of the wheel rim 5, and the wheel rim 15 has a drop part 15*a* cylindrical in shape, smaller in outside diameter and side parts 15*b*, 15*b*, larger in outside diameter, on respective sides of the drop part 15*a*, a flaring ratio of each of the side parts 15*b*, 15*b*, respectively, being greater than that for the drop part 15*a*. However, the wheel rim 15 differs from the wheel rim 5 in that parts of the side parts 15*b*, 15*b*, respectively, adjacent to the outer edges thereof, respectively, are cylindrical in shape (the parts each have no change in outside diameter), As shown in FIG. 6, the wheel rim 15 is manufactured by use of a metal mold having a forming face in a sectional shape along the outer shape of the wheel rim 15. A forming method is the same as the method described with reference to FIG. 1, and a metal mold (dividable metal mold) 13 for electromagnetic forming, with a forming face 12, provided on the inner surface side thereof, is disposed on the outer peripheral side of the columnar workpiece 11, indicated by phantom lines while a coil 14 for electromagnetic forming is disposed on the inner peripheral side of the columnar workpiece 11. The central part of the forming face 12 of the metal mold 13 for the electromagnetic forming, corresponding to the drop part of the wheel rim, is cylindrical in shape, having the smallest inside diameter while the inside diameter of each of side parts of the forming face 12, on respective sides of the central part, is larger. Further, parts of the forming face 12, in the vicinity of both edges thereof, are cylindrical in shape (the parts each have no change in outer shape).

In a state shown in FIG. 6, upon throwing electrical energy into the coil 14 for the electromagnetic forming, the columnar workpiece 11 undergoes instantaneous flaring to be butted against the forming face 12 of the metal mold 13, thereby being formed into the wheel rim 15 in a shape along the forming face 12.

Observing the forming face 12 of the metal mold 13 for the electromagnetic forming, it is found that the inside diameter thereof gradually increases from the central part toward the respective ends thereof without any spot where the inside diameter decreases although the inside diameter becomes constant part of the way. Meanwhile, observing the wheel rim 15, it is found that there is no spot where the outside diameter thereof decreases part of the way from the drop part 15*a* toward respective rim outer edges 15*c*, 15*c*, as with the case of the wheel rim 5. Further, the wall thickness of the wheel rim 15 is the largest at the drop part 15*a*, gradually decreasing toward the respective rim outer edges 15*c*, 15*c*, without any spot where the wall thickness increases part of the way from the drop part 15*a* toward the respective rim outer edges 15*c*, 15*c*.

Working on wheel rim ends, such as curling, and so forth, is applied to the wheel rim 15 for automotive use, as necessary, and a disc is fixedly attached to the central part thereof to thereby form a wheel, whereupon a tire is securely attached to the outer periphery of the wheel rim.

Figure 7:
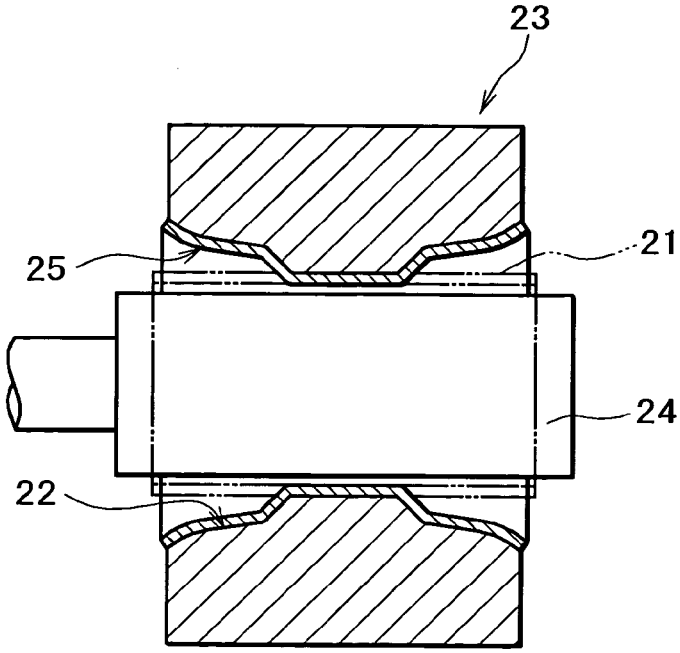
FIG. 7 is a sectional view illustrating another process in the method of manufacturing, according to the invention, for forming an automotive wheel rim by applying the electromagnetic forming to a columnar workpiece.

FIG. 7 shows still another wheel rim, and a method of manufacturing the same. according to the invention A metal mold 23 for electromagnetic forming, shown in FIG. 7, differs from the metal mold 3 in FIG. 1 in that the inner peripheral face of the metal mold 23 comprises a forming face 22 only, corresponding to a drop part of a wheel rim 25, and both side parts thereof, (the length of the metal mold 23, in the axial direction, is shorter than that for the metal mold 3 in FIG. 1), and respective parts of the forming face 22, in the vicinity of the both ends thereof, are bent toward the outside diameter thereof so as to be flared out. A method of forming the wheel rim 25 by the electromagnetic forming is the same as the method described with reference to FIG. 1, and the metal mold (dividable metal mold) 23 for the electromagnetic forming is disposed on the outer peripheral side of a columnar workpiece 21, indicated by phantom lines, while a coil 24 for electromagnetic forming is disposed on the inner peripheral side of the columnar workpiece 21.

In a state shown in FIG. 7, upon throwing electrical energy into the coil 24 for the electromagnetic forming, the columnar workpiece 21 undergoes instantaneous flaring to be butted against the forming face 22 of the metal mold 23, thereby being formed into the wheel rim 25 in a shape along the forming face 22.

With the wheel rim 25, there is no spot where the outside diameter thereof decreases part of the way from the drop part toward respective rim outer edges thereof, as with the case of the wheel rim 5. Further, the wall thickness of the wheel rim 25 is the largest at the drop part, gradually decreasing toward the respective rim outer edges without any spot where the wall thickness increases part of the way from the drop part toward the respective rim outer edges. As the parts of the wheel rim 25, in the vicinity of the respective rim outer edges thereof, are formed in a sectional shape slightly curved toward the outside diameter thereof so as to be flared out, subsequent curling can be executed with greater ease.

Figure 8:
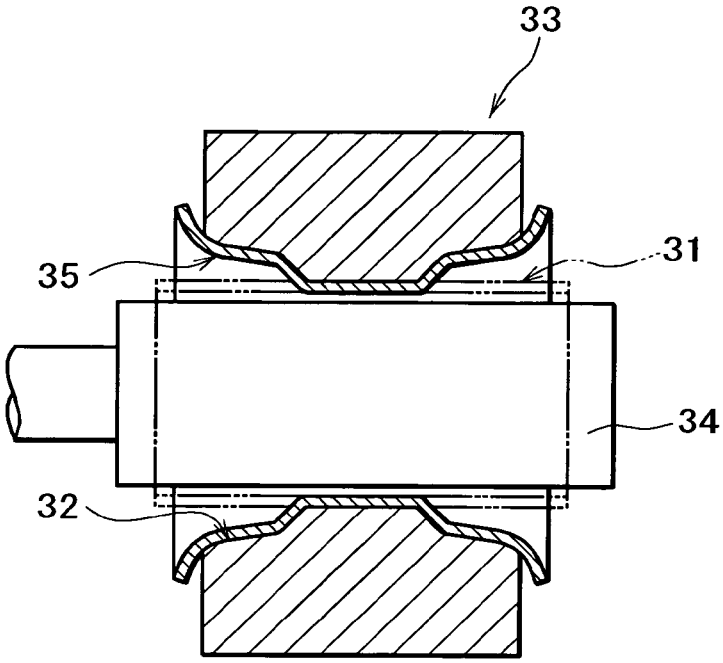
FIG. 8 is a sectional view illustrating still another process in the method of manufacturing, according to the invention, for forming an automotive wheel rim by applying the electromagnetic forming to a columnar workpiece.

FIG. 8 shows a further wheel rim, and a method of manufacturing the same, according to the invention.

A metal mold 33 for the electromagnetic forming, shown in FIG. 8, differs from the metal mold 3 in FIG. 1 in that the inner peripheral face of the metal mold 33 comprises a forming face 32 corresponding to a drop part of a wheel rim 35, and respective parts of both side parts thereof (the length of the metal mold 33, in the axial direction, is still shorter than that for the metal mold 23 in FIG. 7), and respective parts of the forming face 32, in the vicinity of the both ends thereof, are bent toward the outside diameter thereof so as to be flared out. A method of forming the wheel rim 35 by the electromagnetic forming is the same as the method described with reference to FIG. 1, and the metal mold (dividable metal mold) 33 for the electromagnetic forming is disposed on the outer peripheral side of a columnar workpiece 31, indicated by phantom lines, while a coil 34 for electromagnetic forming is disposed on the inner peripheral side of the columnar workpiece 31.

In a state shown in FIG. 8, upon throwing electrical energy into the coil 34 for the electromagnetic forming, the columnar workpiece 31 undergoes instantaneous flaring to be butted against the forming face 32 of the metal mold 33, thereby being formed into a shape along the forming face 32. However, parts of the wheel rim 35 as formed, in the vicinity of respective rim outer edges thereof, lie outside of respective ends of the forming face 32, in the axial direction, and are not butted against the forming face 32, so that the parts of the wheel rim 35 undergo free deformation in response to a forming force applied and are thereby formed into a sectional shape curved toward the outside diameter thereof so as to be flared out.

With the wheel rim 35, there is no spot where the outside diameter thereof decreases part of the way from the drop part toward the respective rim outer edges thereof, as with the case of the wheel rim 5. Further, the wall thickness of the wheel rim 35 is the largest at the drop part, gradually decreasing toward the respective rim outer edges without any spot where the wall thickness increases part of the way from the drop part toward the respective rim outer edges. Since the parts of the wheel rim 35, in the vicinity of the respective rim outer edges thereof, are formed in a sectional shape curved toward the outside diameter thereof so as to be flared out, subsequent curling can be executed with greater ease.

Figure 9:
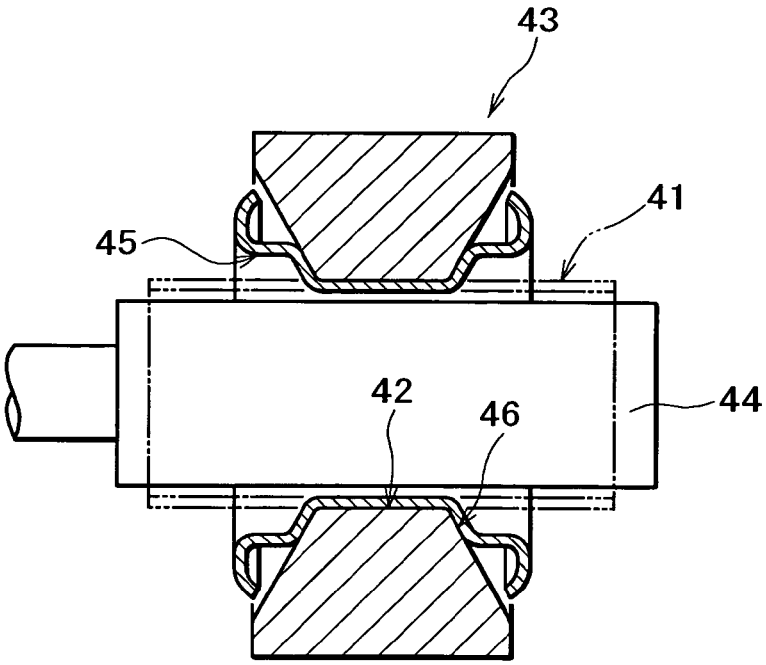
FIG. 9 is a sectional view illustrating a further process in the method of manufacturing, according to the invention, for forming an automotive wheel rim by applying the electromagnetic forming to a columnar workpiece.

FIG. 9 shows a still further wheel rim, and a method of manufacturing the same, according to the invention.

A metal mold 43 for electromagnetic forming, shown in FIG. 9, differs from the metal mold 3 in FIG. 1 in that the inner peripheral face of the metal mold 43 comprises a forming face 42 only, corresponding to a drop part of a wheel rim 45 (the length of the metal mold 43, in the axial direction, is still shorter than that for the metal mold 33 in FIG. 8), and both side faces of the metal mold 43 constitute respective forming faces 46 corresponding to sidewalls (steep tilted parts on the respective sides of the drop part) of the wheel rim 45. A method of forming the wheel rim 45 by the electromagnetic forming is the same as the method described with reference to FIG. 1, and the metal mold (dividable metal mold) 43 for the electromagnetic forming is disposed on the outer peripheral side of a columnar workpiece 41, indicated by phantom lines, while a coil 44 for electromagnetic forming is disposed on the inner peripheral side of the columnar workpiece 41.

In a state shown in FIG. 9, upon throwing electrical energy into the coil 44 for the electromagnetic forming, the columnar workpiece 41 undergoes instantaneous flaring to be butted against the forming face 42 of the metal mold 43, thereby being formed into a shape along the forming face 42. However, both side parts of the wheel rim 45 lie outside of the respective ends of the forming face 42, in the axial direction, and are not butted against the forming face 42, so that respective parts (sidewall portions) of the both side parts are formed along the forming face 46 in response to a forming force of the electromagnetic forming while respective remaining portions (respective portions outside the sidewalls of the both side parts) of the both side parts undergo free deformation, thereby forming respective parts of the both side parts, in the vicinity of respective rim outer edges, into a shape curled inward in the axial direction, as shown in FIG. 9.

With the wheel rim 45, there is no spot where the outside diameter thereof decreases part of the way from the drop part toward the respective rim outer edges thereof, as with the case of the wheel rim 5. Further, the wall thickness of the wheel rim 45 is the largest at the drop part, gradually decreasing toward the respective rim outer edges without any spot where the wall thickness increases part of the way from the drop part toward the respective rim outer edges. Since the parts of the wheel rim 45, in the vicinity of the respective rim outer edges thereof, are curled, subsequent curling can be executed with greater ease.

Figure 10:
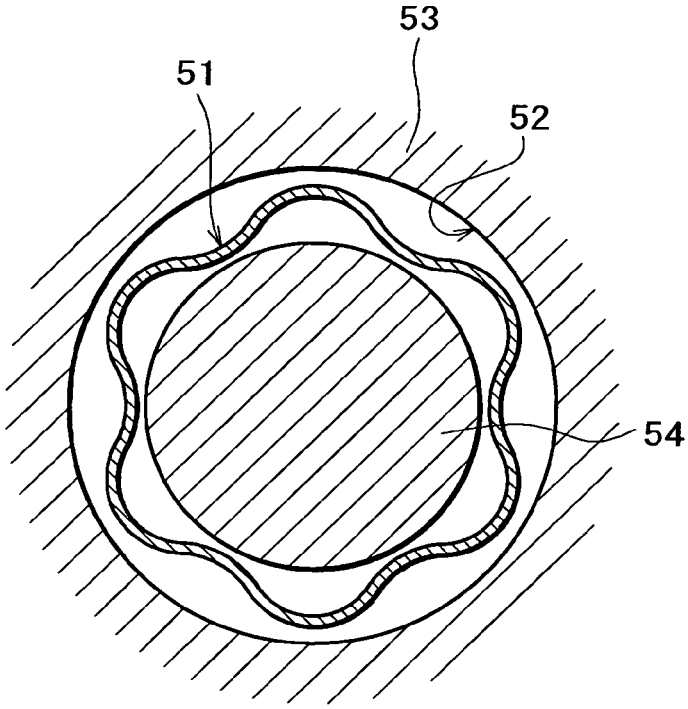
FIG. 10 is a sectional view (section normal to the axial direction of an automotive wheel rim) illustrating a still further process in the method of manufacturing, according to the invention, for forming the automotive wheel rim by applying the electromagnetic forming to a columnar workpiece.

FIG. 10 shows a yet further wheel rim, and a method of manufacturing the same, according to the invention.

A method of manufacturing the wheel rim, shown in FIG. 10, is the same as the method described with reference to FIG. 1 except that a columnar workpiece differs in shape. That is, in place of the columnar workpiece 1 in the shape of a cylinder, use is made of a columnar workpiece 51 with a columnar sidewall in the cross-sectional shape of waves continuous along the circumferential direction of the columnar workpiece 51.

As shown in FIG. 10, a metal mold (dividable metal mold) 53 for electromagnetic forming is disposed on the outer peripheral side of the columnar workpiece 51 while a coil 54 for electromagnetic forming is disposed on the inner peripheral side of the columnar workpiece 51, and electrical energy is thrown into the coil 54 for the electromagnetic forming, whereupon the columnar workpiece 51 undergoes instantaneous flaring to be butted against a forming face 52 of the metal mold 53, thereby being formed into a sectional shape along the forming face 52.

With the above-described methods of manufacturing the wheel rim by the electromagnetic forming, an aluminum alloy extrusion cut to a predetermined length as it is may be used as the columnar workpieces 1, 11, 21, 31, and 41, respectively, however, the same as flared by applying the electromagnetic forming thereto once or a plurality of times may be used as well. Although the aluminum alloy extrusion (pipe), circular in cross section, that can be manufactured by a common extrusion press is said to have a diameter on the order of 200 mm at the maximum, a columnar workpiece larger in diameter than the original size, obtained by flaring the above-described aluminum alloy extrusion by applying the electromagnetic forming thereto, can be subjected to the electromagnetic formation of a wheel rim. By so doing, it is possible to expand the upper limit of the diameter of the wheel rim that can be manufactured.

Figure 11:
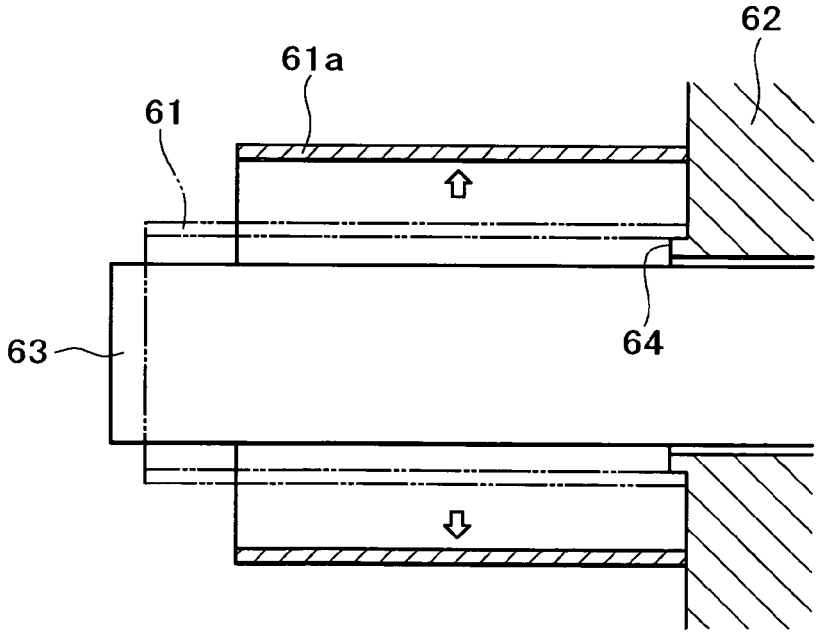
FIG. 11 is a sectional view illustrating a method of forming a cylindrical workpiece by causing an extrusion to undergo flaring by means of the electromagnetic forming.

FIG. 11 is a sectional view illustrating a method of causing an extrusion 61 of a predetermined length (a workpiece prepared just by cutting an aluminum alloy extrusion) to undergo flaring. The extrusion 61 is set in a metal mold 62, and a coil 63 for electromagnetic forming is disposed around the center of the extrusion 61. A through-hole for allowing the coil 63 for the electromagnetic forming to penetrate therethrough is formed at the center of the metal mold 62, and a rib 64 for retaining the extrusion 61 is formed around the through-hole. Upon application of the electromagnetic forming by throwing electrical energy into the coil 63 for the electromagnetic forming, the extrusion 61 undergoes flaring in response to magnitude of the electrical energy to be thereby turned into a columnar body 61*a*. By disposing a metal mold having an internal face cylindrical in shape around the extrusion 61 when the electromagnetic forming is applied, the outside diameter of the columnar body 61*a* after flaring can be controlled.

Figure 12A:
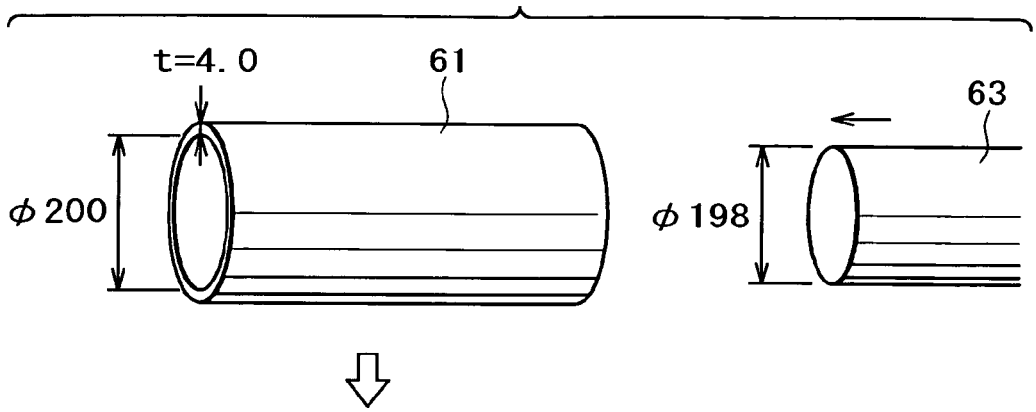
FIGS. 12(*a*), 12(*b*), and 12(*c*) are views each specifically showing a method of forming a columnar workpiece by repeated flaring by means of the electromagnetic forming.
Figure 12B:
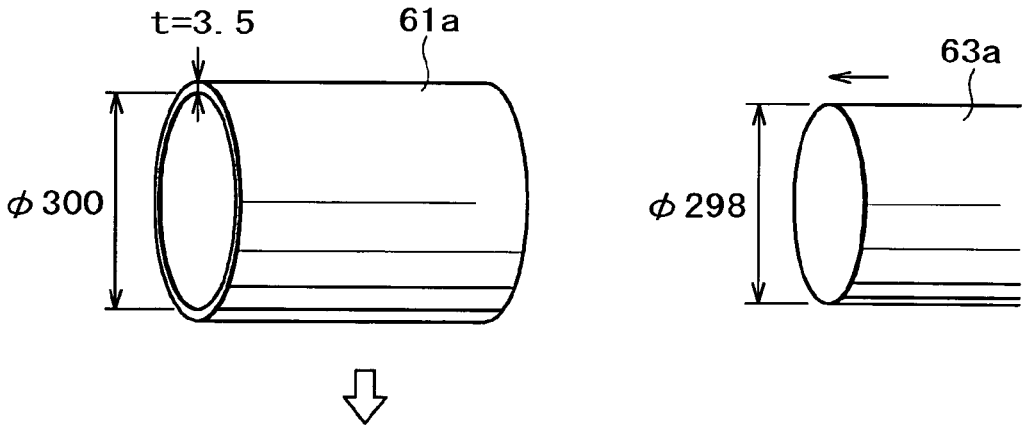
Figure 12C:
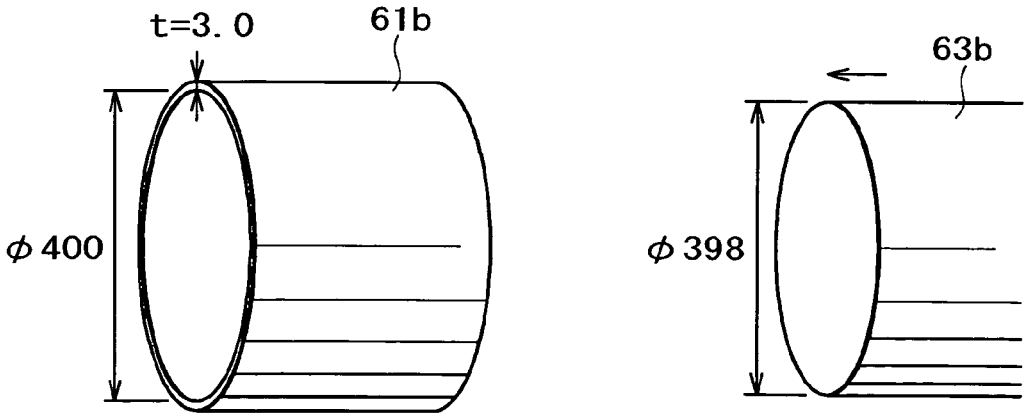

Cylindrical workpieces still larger in diameter can be fabricated by repeating flaring caused by the application of the electromagnetic forming. FIGS. 12(*a*) to 12(*c*) are views showing such processing by way of example. With the use of an extrusion 61, 200 mm in inside diameter, and 4.0 mm in wall thickness, at the outset, the extrusion 61 can be caused to undergo flaring by applying the electromagnetic forming thereto to be thereby turned into a columnar body 61*a*, 300 mm in inside diameter, and 3.5 mm in wall thickness, and the columnar body 61*a* can be caused to undergo further flaring by applying the electromagnetic forming thereto to be thereby turned into a columnar body 61*b*, 400 mm in inside diameter, and 3.0 mm in wall thickness. If a columnar body yet larger in diameter is required, it need only be sufficient to cause the columnar body 61*b* to undergo further flaring. Further, respective outside diameters of coils 63, 63*a*, and 63*b*, for electromagnetic forming, are preferably smaller by only a small margin than respective inside diameters of the extrusion 61, the columnar body 61*a*, and the columnar body 61*b*, before the application of the electromagnetic forming, as shown on the right-hand side in FIGS. 12(*a*) to 12(*c*), respectively.

Figure 14:
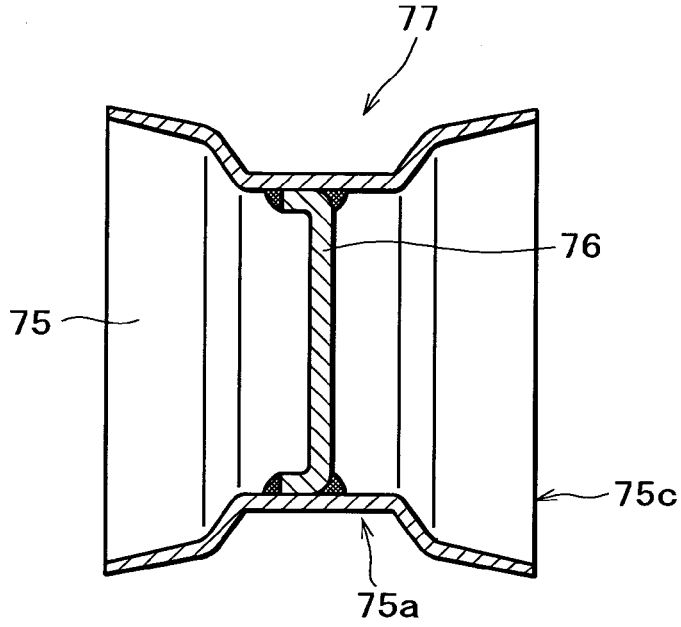
FIG. 14 is a sectional view illustrating a joining method of a disc.

Now, referring to FIG. 14, there is described the step of manufacturing a wheel by joining a wheel rim as formed to a disc separately formed.

A disc 76 in a cup-like shape is obtained by applying press working to a disc-like material. The disc 76 is fitted into the inner peripheral face of a drop part 75*a* of a wheel rim 75 by insertion therethrough to be securely attached thereto. Then, MIG welding is applied to the entire circumference of the disc 76 from the sides of respective faces of the disc 76, thereby joining the disc 76 to the drop part 75*a* of the wheel rim 75. In this case, since the wheel rim that is formed by the manufacturing method according to the invention is used as the wheel rim 75, the wall thickness of the drop part 75*a* is kept equivalent to the wall thickness of a columnar workpiece, so that it is possible to inhibit weld strain when the MIG welding is applied. Further, since the disc 76 is in the cup-like shape, the face thereof, joined to the inner peripheral face of the drop part 75*a*, can be rendered wider in area, thereby enabling strong joint to be implemented.

As for a material for the disc 76, the material that can be joined to the wheel rim 75 by welding may be selected as appropriate. In the case of an embodiment of the invention, shown in FIG. 14, the disc 76 in the cup-like shape is used, however, a disc in a flat sheet shape may be used as well provided that necessary joint strength after welding is obtained. Further, the method of working the disc 76 into the cup-like shape is not limited to the press working, and various other methods of working, such as spinning, and so forth, may be used as appropriate. For the above-described working, the electromagnetic forming also may be adopted.

As a method of joining the disc 76 to the drop part 75*a* of the wheel rim 75 other than the MIG welding, use may be made of TIG welding, and so forth. Furthermore, as a method of joining, other than those arc welding, laser welding, electron beam welding, and so forth also may be used. In addition, mechanical joining by use of rivets may be used instead. A joining method in common use may be used in either case, and there is no need for adopting a special joining method. If use is made of the wheel rim that is formed by the manufacturing method according to the invention, the wall thickness of the drop part 75*a* is kept equivalent to the wall thickness of the columnar workpiece, so that the wall thickness of the columnar workpiece may be determined depending on a joining method as adopted. With the use of the wheel rim formed by the manufacturing method according to the invention, even if the wall thickness of the columnar workpiece is determined in such a way as described, there is a tendency that parts unrelated to joining are rendered smaller in wall thickness, leading therefore to reduction in weight of the wheel rim as a whole.

With the method of manufacturing a wheel according to the invention, curling may be applied to outer edges of a wheel rim, which will be described hereinafter with reference to FIG. 15.

Figure 15:
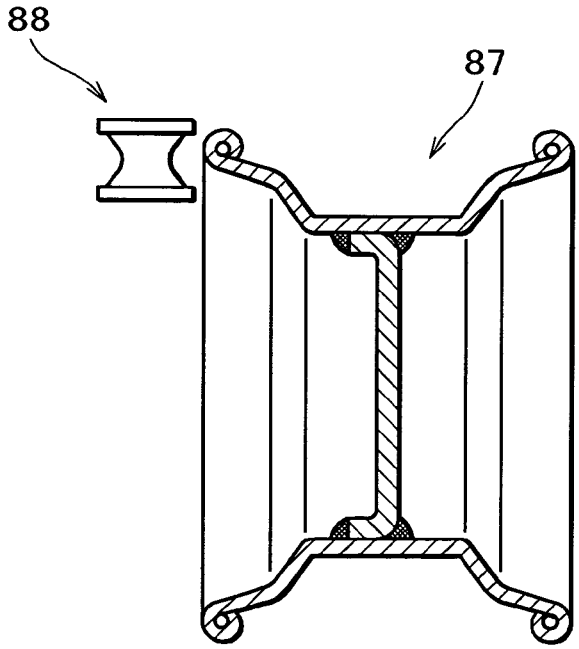
FIG. 15 is a sectional view illustrating curling applied to rim outer edges.

In FIG. 15, curling is applied by setting a wheel 87 comprising a wheel rim with a disc securely attached thereto in a spinning machine, and rotating the spinning machine at a predetermined frequency, thereby pressing a forming roll 88 against rim outer edges of the wheel 87. In this case, since the wheel rim formed by the manufacturing method according to the invention is in use as the wheel rim, the wall thickness of the rim outer edges is rendered small, so that curling can be executed with ease.

Further, in this case, the disc is first joined to the wheel rim, and subsequently, the curling is applied to the rim outer edges, however, in reverse order, the curling maybe first applied to the rim outer edges, and subsequently, the disc may be joined to the wheel rim.

WORKING EXAMPLE

In accordance with the embodiment of the invention, use was made of a columnar workpiece 200 mm in inside diameter, 3.0 mm in wall thickness, and 300 mm in length, prepared from an aluminum alloy extrusion (6063 among the O-alloys), circular in shape, the columnar workpiece was set inside a metal mold for electromagnetic forming, as shown in FIG. 1, and a coil for electromagnetic forming, 198 mm in outside diameter, and 300 mm in length, was inserted into the columnar workpiece, whereupon the columnar workpiece was subjected to the electromagnetic forming at discharged electric energy of 30 kJ to undergo flaring, thereby obtaining a wheel rim. Respective sectional shapes of the columnar workpiece, and the wheel rim thus obtained are shown in FIGS. 13(*a*) and 13(*b*), respectively.

Figure 13A:
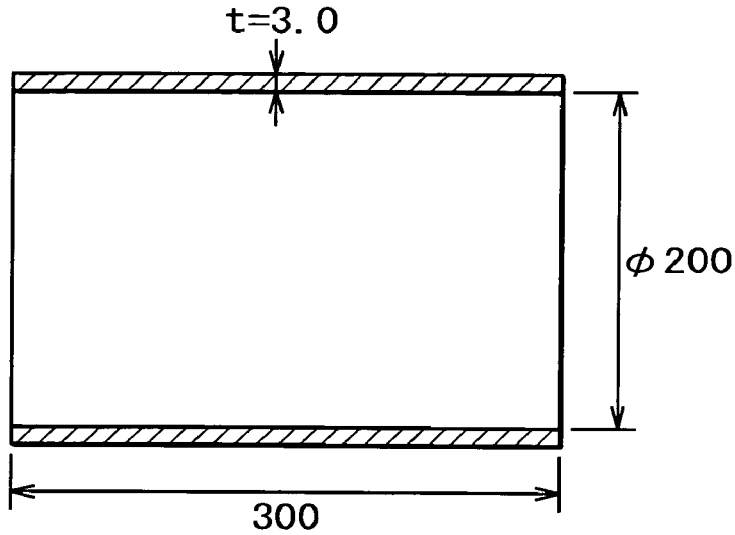
FIGS. 13(*a*) and 13(*b*) are views showing respective sectional shapes of a columnar workpiece used in carrying out the working example of the invention, and a wheel rim manufactured by means of the electromagnetic forming, in which FIG. 13(*a*) shows sectional dimensions of the columnar workpiece, and FIG. 13(*b*) shows sectional dimensions of the wheel rim.
Figure 13A:
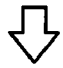
Figure 13B:
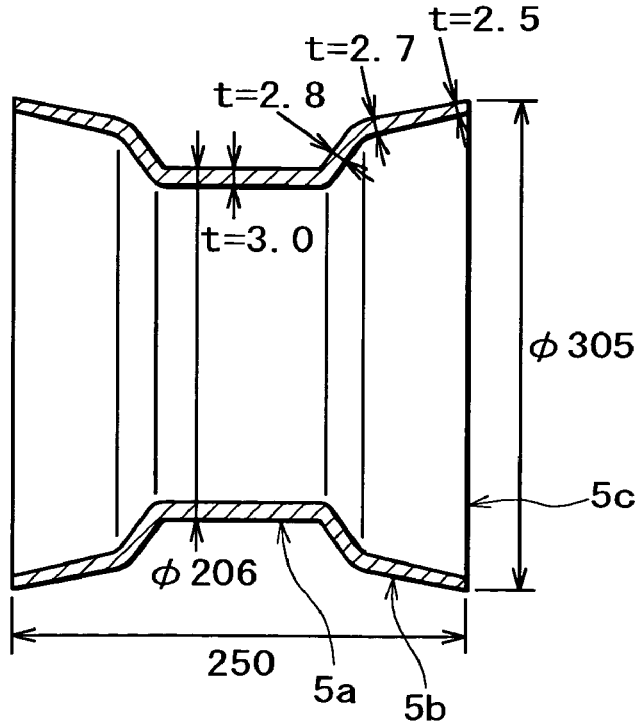

As shown in FIG. 13(*b*), the outside diameter of a drop part 5*a* of the wheel rim after the electromagnetic forming was found at 206 mm, the outside diameter of each of rim outer rim edges 5*c* at 305 mm, and the width from side to side of the wheel rim at 250 mm while, upon observation of wall thickness with respect to respective parts of the wheel rim, the wall thickness of the drop part 5*a* remained at 3.0 mm since the drop part 5*a* did not undergo flaring, however, each of both side parts 5*b* was found to continuously decrease in wall thickness from 2.8 mm to 2.7 mm, and further, to 2.5 mm as the same comes closer toward each of the rim outer rim edges 5*c*.

Next, by applying press working to a disc-like material (6N01 among the O-alloys) 300 mm in diameter, and 5 mm in wall thickness, a disc 6 in a cup-like shape, 200 mm in bottom diameter, and 50 mm high, was obtained. The disc 6 was fitted into the inner peripheral face of the drop part 5*a* of the wheel rim 5 by insertion therethrough to be securely attached thereto. Then, MIG welding with a welding current at 150 to 180 A was applied to the entire circumference of the disc 6 from the sides of both faces of the disc 6, in argon gas as a shield gas, using a welding wire A4043WY 1.2 mm in diameter. Since the wall thickness of the drop part 5*a* was kept equivalent to the wall thickness of the columnar workpiece, it was possible to inhibit weld strain when the MIG welding was applied. Further, since the disc 6 was formed in the cup-like shape, it was possible to widen an area of a face thereof, joined to the inner peripheral face of the drop part 5*a*, thereby enabling strong joint to be implemented.

With the working example as described above, the press working was applied in obtaining the disc in the cup-like shape, however, the electromagnetic forming may be applied instead. More specifically, as with the case of the working example, the disc-like material (6N01 among the O-alloys) 300 mm in diameter, and 5 mm in wall thickness may be placed on top of a flat-sheet-like coil, and at the same time, a metal mold in a cup-like shape as desired may be disposed above the disc-like material, whereupon the electromagnetic forming was applied thereto at discharged electric energy of 35 kJ, thereby obtaining the disc in the cup-like shape, 200 mm in bottom diameter, and 50 mm high.

What is claimed is:

1. A method of manufacturing an aluminum alloy wheel for automotive use, comprising the steps of:

disposing a columnar workpiece in a metal mold for electromagnetic forming, with the inner peripheral face of the metal mold serving as a forming face for the outer peripheral side of the columnar workpiece having a wall thickness uniform throughout a body thereof, and disposing a coil for electromagnetic forming on the inner peripheral side of the columnar workpiece;

throwing electric energy into the coil for electromagnetic forming, thereby causing the columnar workpiece to undergo flaring to be pressed against the forming face of the metal mold for electromagnetic forming, and forming a wheel rim having a drop part small in outside diameter, and two side parts each larger in outside diameter than the drop part, so that a flaring ratio of each of the two side parts is greater than that for the drop part; and applying curling to outer edges of the wheel rim.

2. A method of manufacturing an aluminum alloy wheel for automotive use, according to claim 1, wherein, for the columnar workpiece, use is made of a cylindrical workpiece.

3. A method of manufacturing an aluminum alloy wheel for automotive use, according to claim 2, wherein the cylindrical workpiece is made out of an aluminum alloy extrusion.

4. A method of manufacturing an aluminum alloy wheel for automotive use, according to claim 3, wherein the aluminum alloy extrusion columnar in shape is caused to undergo flaring by applying the electromagnetic forming thereto to be thereby turned into the cylindrical workpiece.

5. A method of manufacturing an aluminum alloy wheel for automotive use, according to claim 3, wherein, for the cylindrical workpiece, use is made of a columnar workpiece made out of the aluminum alloy extrusion with a columnar sidewall in the cross-sectional shape of waves continuous along the circumferential direction of the columnar workpiece.

6. A method of manufacturing an aluminum alloy wheel for automotive use, according to claim 1, wherein the inner peripheral face of the metal mold for the electromagnetic forming comprises a portion of the forming face, in a shape corresponding to the drop part of the wheel rim.

7. A method of manufacturing an aluminum alloy wheel for automotive use, according to claim 1, wherein the inner peripheral face of the metal mold for the electromagnetic forming comprises a portion of the forming face, in a shape corresponding to the drop part of the wheel rim, and respective parts of both the side parts thereof.

8. A method of manufacturing an aluminum alloy wheel for automotive use, according to claim 1, wherein the metal mold for the electromagnetic forming has the forming face in a shape corresponding to the drop part of the wheel rim and both the side parts thereof.

9. A method of manufacturing an aluminum alloy wheel for automotive use, according to claim 1, wherein the central part of the forming face, corresponding to the drop part, has the smallest inside diameter and the inside diameter of the forming face gradually increases from the central part toward respective ends thereof, in the axial direction, without any spot where the inside diameter decreases part of the way toward the respective ends, in the axial direction.

10. A method of manufacturing an aluminum alloy wheel for automotive use, comprising the steps of:

disposing a columnar workpiece in a metal mold for electromagnetic forming, with the inner peripheral face of the metal mold serving as a forming face for the outer peripheral side of the columnar workpiece having a wall thickness uniform throughout a body thereof;

disposing a coil for electromagnetic forming on the inner peripheral side of the columnar workpiece;

throwing electric energy into the coil for electromagnetic forming of the columnar workpiece, thereby causing the columnar workpiece to undergo flaring to be pressed against the forming face of the metal mold for electromagnetic forming, and forming a wheel rim having a drop part small in outside diameter, and two side parts each larger in outside diameter than the drop part, so that a flaring ratio of each of the two side parts is greater than that for the drop part;

forming a disc separately from the wheel rim; and joining the disc to the inner peripheral face of the drop part of the wheel rim.

11. A method of manufacturing an aluminum alloy wheel for automotive use, according to claim 1, further comprising the step of applying curling to outer edges of the wheel rim.

12. A method of manufacturing an aluminum alloy wheel for automotive use, according to claim 11, wherein the step of applying curling to the outer edges of the wheel rim is executed after the step of joining the disc.

13. A method of manufacturing an aluminum alloy wheel for automotive use, according to claim 11, wherein the step of applying curling to the outer edges of the wheel rim is executed before the step of joining the disc.

14. A method of manufacturing an aluminum alloy wheel for automotive use, according to claim 10, wherein, for the columnar workpiece, use is made of a cylindrical workpiece.

15. A method of manufacturing an aluminum alloy wheel for automotive use, according to claim 14, wherein the cylindrical workpiece is made out of an aluminum alloy extrusion.

16. A method of manufacturing an aluminum alloy wheel for automotive use, according to claim 1, wherein the step of joining the disc is executed by welding.

17. A method of manufacturing an aluminum alloy wheel for automotive use, according to claim 10, wherein the central part of the forming face, corresponding to the drop part, has the smallest inside diameter, and the inside diameter of the forming face gradually increases from the central part toward respective ends thereof, in the axial direction, without any spot where the inside diameter decreases part of the way toward the respective ends, in the axial direction.

18. A method of manufacturing an aluminum alloy wheel for automotive use, comprising the steps of:

disposing a columnar workpiece in a metal mold for electromagnetic forming, with the inner peripheral face of the metal mold having a plurality of steps and serving as a forming face for the outer peripheral side of the columnar workpiece;

disposing a coil for electromagnetic forming on the inner peripheral side of the columnar workpiece;

causing the columnar workpiece to undergo flaring to be pressed against the forming face of the metal mold in a single forming step by throwing electric energy into the coil for electromagnetic forming of the columnar workpiece, thereby forming a wheel rim having a drop part small in outside diameter, and two stepped side parts each larger in outside diameter than the drop part, so that a flaring ratio of each of the two side parts is greater than that for the drop part;

forming a disc separately from the wheel rim; and joining the disc to the inner peripheral face of the drop part of the wheel rim.

19. A method of manufacturing an aluminum alloy wheel for automotive use, comprising the steps of:

disposing a columnar workpiece in a metal mold for electromagnetic forming, with the inner peripheral face of the metal mold having a plurality of steps and serving as a forming face for the outer peripheral side of a columnar workpiece;

disposing a coil for electromagnetic forming on the inner peripheral side of the columnar workpiece; and causing the columnar workpiece to undergo flaring to be pressed against the forming face of the metal mold in a single forming step by throwing electric energy into the coil for electromagnetic forming, thereby forming a wheel rim having a drop part small in outside diameter, and two stepped side parts each larger in outside diameter than the drop part, so that a flaring ratio of each of the two side parts is greater than that for the drop part.

* * * * *